US009960555B2

(12) United States Patent
Okuley

(10) Patent No.: US 9,960,555 B2
(45) Date of Patent: May 1, 2018

(54) UNIVERSAL SERIAL CONNECTOR

(71) Applicant: Intel Corporation, Santa Clara, CA (US)

(72) Inventor: James M. Okuley, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 0 days. days.

(21) Appl. No.: 15/036,025

(22) PCT Filed: Dec. 27, 2013

(86) PCT No.: PCT/US2013/078022

§ 371 (c)(1),
(2) Date: May 11, 2016

(87) PCT Pub. No.: WO2015/099772

PCT Pub. Date: Jul. 2, 2015

(65) Prior Publication Data

US 2016/0294134 A1 Oct. 6, 2016

(51) Int. Cl.

| | |
|---|---|
| ***H01R 25/00*** | (2006.01) |
| ***H01R 27/02*** | (2006.01) |
| ***H01R 24/60*** | (2011.01) |
| ***H01R 13/62*** | (2006.01) |

(52) U.S. Cl.
CPC ..... *H01R 27/02* (2013.01); *H01R 13/62* (2013.01); *H01R 24/60* (2013.01)

(58) Field of Classification Search
CPC ..... H01R 31/06; H01R 31/065; H01R 31/02; H01R 23/025; H01R 2103/00; H01R 2201/06
USPC ..... 439/638, 639, 502
See application file for complete search history.

(56) References Cited

U.S. PATENT DOCUMENTS

| | | | | |
|---|---|---|---|---|
| 6,435,409 | B1 | 8/2002 | Hu | |
| 7,101,221 | B1 * | 9/2006 | Chen | H01R 25/16 439/502 |
| 7,942,691 | B1 * | 5/2011 | McSweyn | H01R 13/72 439/501 |
| 8,073,985 | B1 * | 12/2011 | Ni | G06F 12/1416 439/660 |
| 8,517,772 | B2 * | 8/2013 | Wu | H01R 24/62 439/501 |

(Continued)

FOREIGN PATENT DOCUMENTS

| | | |
|---|---|---|
| KR | 100791583 | 1/2008 |
| KR | 20100029910 | 3/2010 |

OTHER PUBLICATIONS

International Search Report and Written Opinion for PCT/US2013/078022 dated Sep. 24, 2014, 18 pages.

(Continued)

*Primary Examiner* — Hein Vu
(74) *Attorney, Agent, or Firm* — Womble Bond Dickinson (US) LLP

(57) ABSTRACT

An apparatus includes a connector body having a first side and a second side, and having a first edge and a second edge and a plurality of electrical connectors along the first edge and the second edge, wherein the connectors on the first edge conform to a first interface format and the connectors on the second edge conform to a second interface format.

10 Claims, 7 Drawing Sheets

(56) References Cited

U.S. PATENT DOCUMENTS

| | | | | |
|---|---|---|---|---|
| 8,870,601 | B2 * | 10/2014 | Lee | H01R 27/00 439/131 |
| 9,004,951 | B2 * | 4/2015 | Wu | H01R 27/00 439/638 |
| 2004/0014336 | A1 * | 1/2004 | Merz | H01R 13/6658 439/76.1 |
| 2006/0286865 | A1 | 12/2006 | Chou et al. | |
| 2008/0191033 | A1 * | 8/2008 | Cuellar | G06K 19/072 235/492 |
| 2015/0024612 | A1 * | 1/2015 | Little | H05K 1/117 439/55 |

OTHER PUBLICATIONS

International Preliminary Report for PCT Application No. PCT/US2013/078022 dated Jul. 7, 2016, 9 pages.

* cited by examiner

UNIVERSAL SERIAL CONNECTOR

CROSS-REFERENCE TO RELATED APPLICATION

This patent application is a U.S. National Phase Application under 35 U.S.C. § 371 of International Application No. PCT/US2013/078022, filed Dec. 27, 2013, entitled "UNIVERSAL SERIAL CONNECTOR," the entire contents of which are incorporated herein by reference.

TECHNICAL FIELD

Embodiments relate to universal serial connectors. More particularly, embodiments relate to a single connector that conforms to multiple form factors.

BACKGROUND

There currently exist many different types of Universal Serial Bus (USB) connectors, for example. Continuing the USB example, there are Type A plugs and Type B receptacles. Further, there are standard, mini and micro sizes. If a user has many different types of electronic devices (e.g., cellular phones, smart phones, tablets, cameras, recording devices) the user may have may different types of cables. Because these cables can become tangled together or lost. Thus, the user may have one or more cable, but may not have the desired cable.

BRIEF DESCRIPTION OF THE DRAWINGS

Embodiments are illustrated by way of example, and not by way of limitation, in the figures of the accompanying drawings in which like reference numerals refer to similar elements.

DETAILED DESCRIPTION

In the following description, numerous specific details are set forth. However, embodiments may be practiced without these specific details. In other instances, well-known circuits, structures and techniques have not been shown in detail in order not to obscure the understanding of this description.

There is described herein various embodiments of a single Universal Serial Bus (USB) connector that can fit both form factor constrained smaller devices and larger devices that have higher speed connections. In one embodiment, both the smaller and larger connectors have the same z-height. In one embodiment, the single connector can be intuitively plugged in to a small slot or a larger width slot for higher speed connections. While the examples herein are directed to USB interfaces other and/or additional interfaces can utilize similar connectors. USB refers to various standards available from USB Implementers Forum, Inc. and includes USB 1.0 released January 1996, USB 2.0 released April 2000, USB 3.0 released November 2008 as well as subsequent versions.

In one embodiment, the USB cable has the same connector on both ends. In one embodiment, the USB connect can operate in multiple directions and is "flipable" so that it can operate with either side up. In one embodiment, the USB connector combines both a straight connector and a right angle connector. In one embodiment, the connector has configurable pins depending on the orientation of the connector. In one embodiment, the connector includes detents in both orientations so that the connector can be held in place in multiple orientations. These detents can be more robust than standard USB connectors without the need for vulnerable tabs on either male or female connectors.

Figure 1:
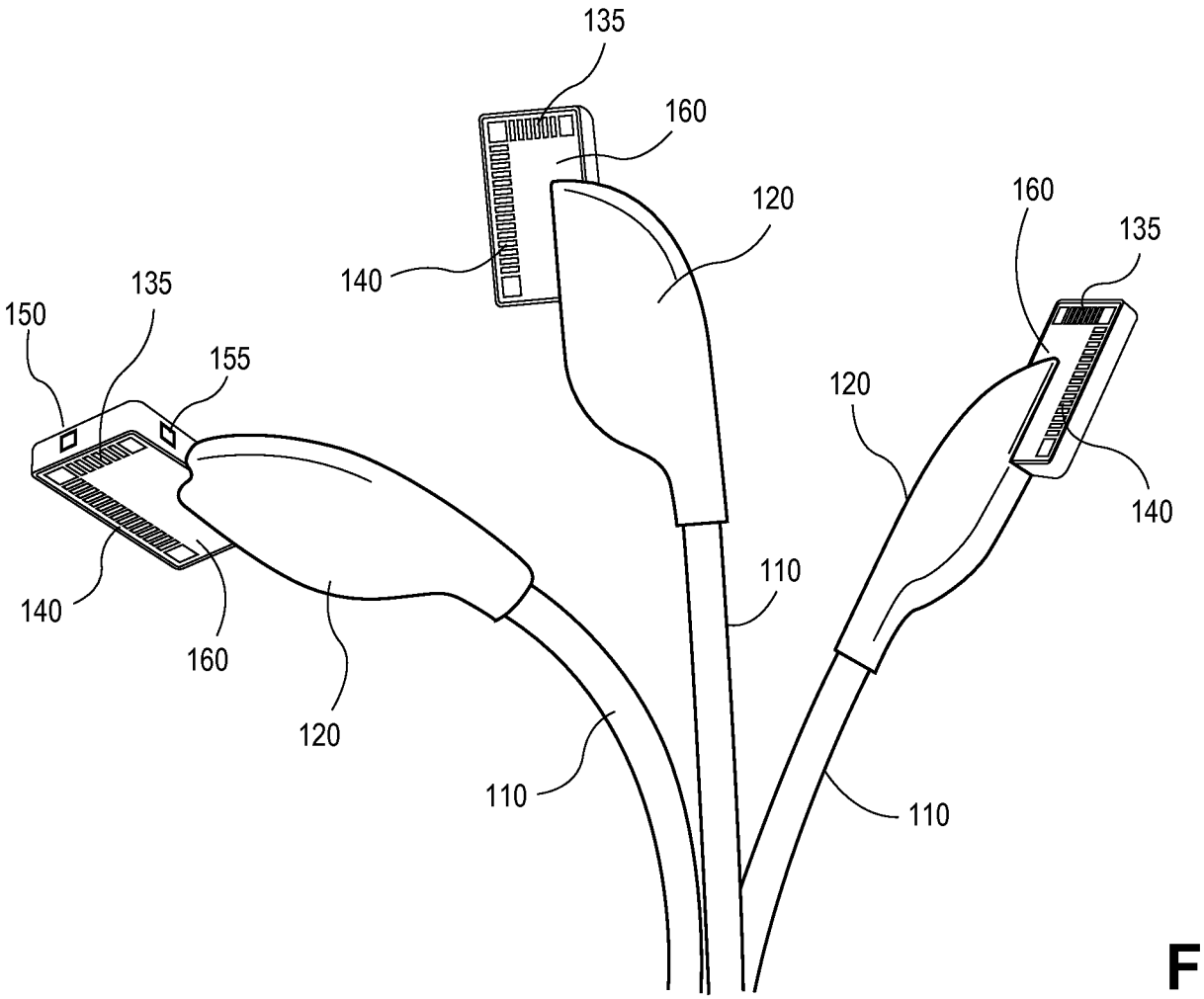
FIG. 1 illustrates one embodiment of a single connector that conforms to multiple USB formats.

FIG. 1 illustrates one embodiment of a single connector that conforms to multiple USB formats. FIG. 1 includes three views of the same embodiment that includes an open connector that can communicate according to two or more USB standards. In one embodiment, each cable 110 includes the same connectors on each end. In alternate embodiments, cable 110 can have different connectors on each end.

In one embodiment, cable 110 can include grip 120. In one embodiment, grip 120 provides an area for a user's fingers to grip the cable and connectors when inserting and/or removing connectors. In one the embodiment illustrated in FIG. 1, connector body 140 has exposed connectors (135 and 140) on two edges. The connectors can function to operate according to two or more USB formats.

Also in the embodiment illustrated in FIG. 1, connector body 160 can have connectors on two sides. Thus, there would not be a specified top and bottom as with current USB connectors. In one embodiment, connector body 160 has a shorter side 135 and a longer side 140. Shorter side 135 may be configured to communicate using one of the smaller USB formats (e.g., micro, mini) while longer side 140 may be configured to communicate using one of the larger USB formats. In one embodiment, one or more of the connectors on connector body 140 is selectively operable based on the USB format in use. That is, one or more of the connectors may be disabled if not needed.

In one embodiment, connector body 140 can have one or more detents (e.g., 150, 155) that operate to hold the connector body within a USB receptacle of an electronic device (e.g., computer system, smartphone, tablet, camera, audio recording device).

Figure 2:
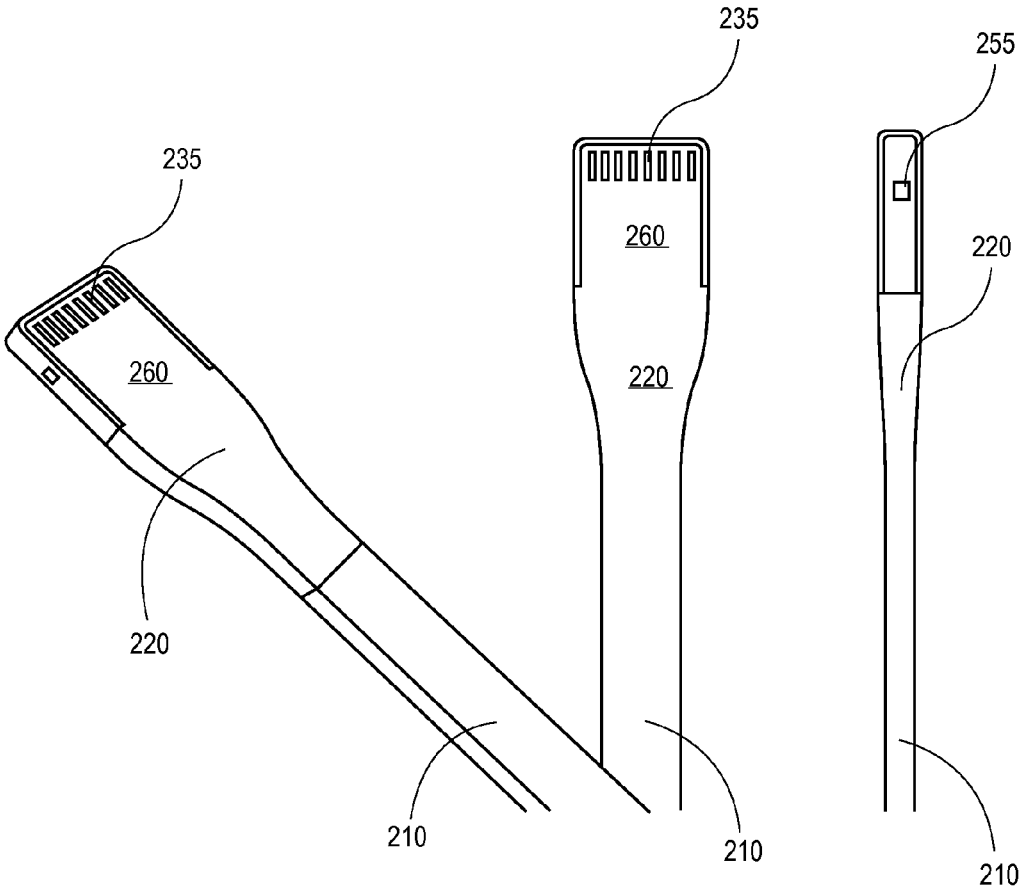
FIG. 2 is an illustration of one embodiment of a USB connector that can support multiple USB formats.

FIG. 2 is an illustration of one embodiment of a USB connector that can support multiple USB formats. The example embodiment of FIG. 2 operates in a similar manner as the example embodiment of FIG. 1 except that connector body 240 has connectors 235 on only one edge. Like the embodiment of FIG. 1, connector body 240 has connectors on both sides so that it can be functional with either side in the "up" position. The embodiment of FIG. 2 may support, for example, USB Mini and USB Micro formats.

Connector body 260 is connected to cable 210 by grip 220. In one embodiment, grip 220 provides an area for a user's fingers to grip the cable and connectors when inserting and/or removing connectors. In one embodiment, each cable 210 includes the same connectors on each end. In alternate embodiments, cable 210 can have different connectors on each end.

Figure 3:
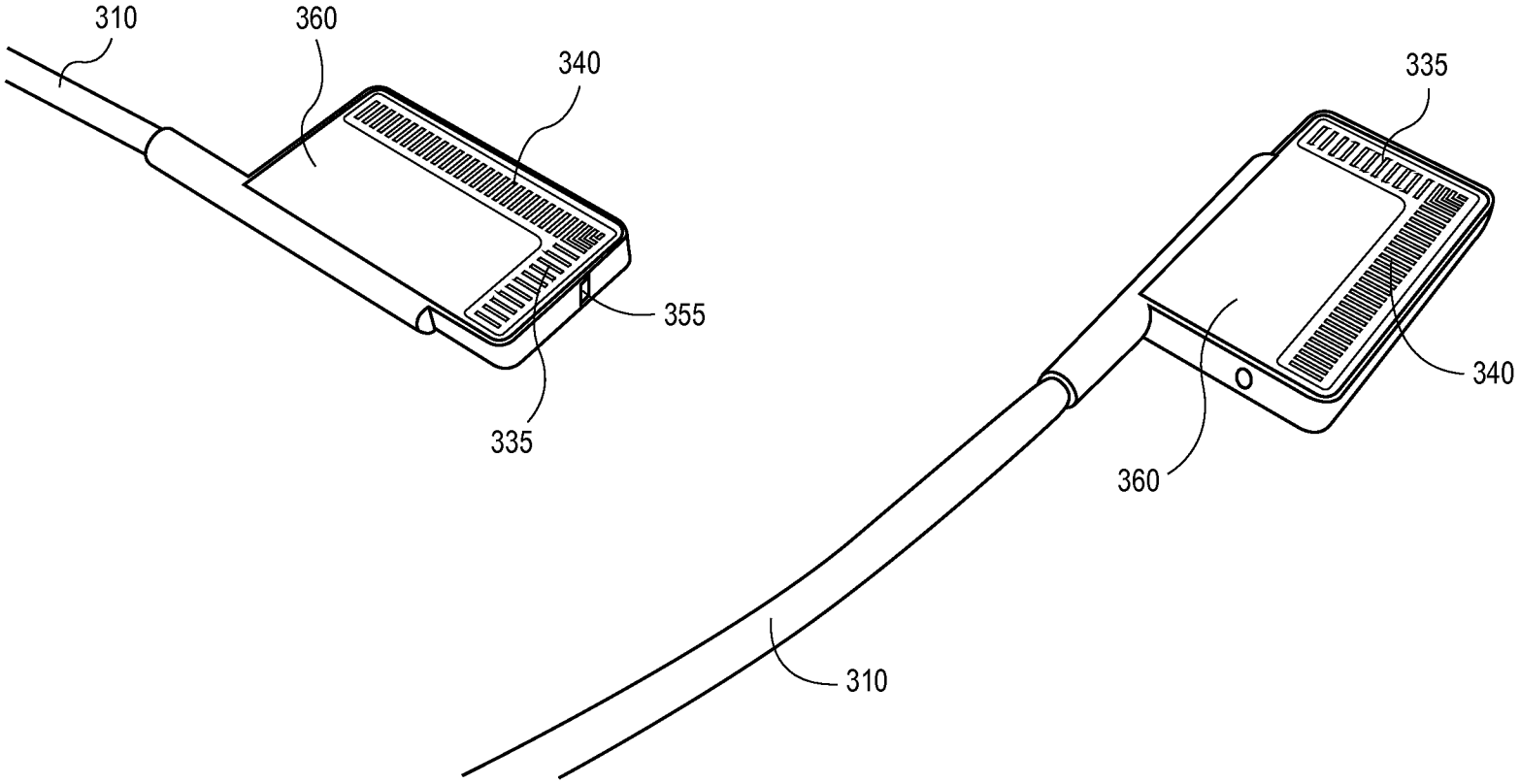
FIG. 3 illustrates one embodiment of a single connector that conforms to multiple USB formats.

FIG. 3 illustrates one embodiment of a single connector that conforms to multiple USB formats. FIG. 3 includes two views of the same embodiment that includes an open connector that can communicate according to two or more USB standards. In one embodiment, each cable 310 includes the same connectors on each end. In alternate embodiments, cable 310 can have different connectors on each end.

In one the embodiment illustrated in FIG. 3, connector body 340 has exposed connectors (335 and 340) on two edges. The connectors can function to operate according to two or more USB formats. Also in the embodiment illustrated in FIG. 3, connector body 360 can have connectors on two sides. Thus, there would not be a specified top and bottom as with current USB connectors.

In one embodiment, connector body 360 has a shorter side 335 and a longer side 340. Shorter side 335 may be configured to communicate using one of the smaller USB formats (e.g., micro, mini) while longer side 340 may be configured to communicate using one of the larger USB formats. In one embodiment, one or more of the connectors on connector body 340 is selectively operable based on the USB format in use. That is, one or more of the connectors may be disabled if not needed.

In one embodiment, connector body 340 can have one or more detents (e.g., 350, 355) that operate to hold the connector body within a USB receptacle of an electronic device (e.g., computer system, smartphone, tablet, camera, audio recording device).

Figure 4:
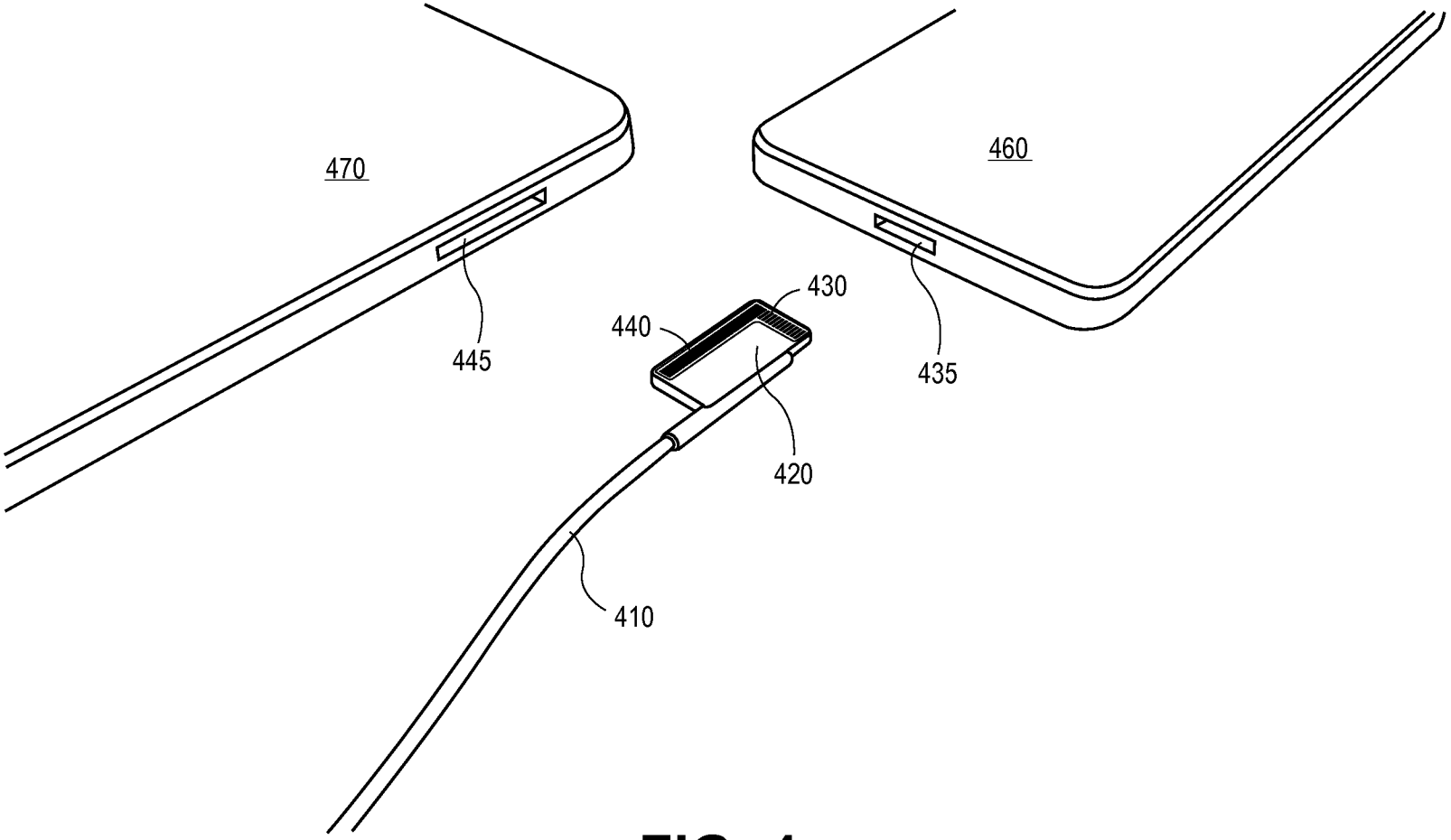
FIG. 4 is a conceptual illustration of a connector that can support multiple USB formats with multiple devices.

FIG. 4 is a conceptual illustration of a connector that can support multiple USB formats with multiple devices. The example of FIG. 4 illustrates a cable as illustrated in FIG. 3; however, other configurations/embodiments can be utilized in a similar manner.

In one the embodiment illustrated in FIG. 4, cable 410 is connected to connector body 420, which has exposed connectors (430 and 440) on two edges. The connectors can function to operate according to two or more USB formats. Also in the embodiment illustrated in FIG. 4, connector body 420 can have connectors on two sides. Thus, there would not be a specified top and bottom as with current USB connectors.

Connectors 430 may correspond to a smaller USB format and fits in receptacle 435. Because connectors 430 and receptacle 435 are smaller, they may be utilized with a smaller electronic device (e.g., 460). Electronic device 460 can be, for example, a smart phone, a camera, a recording device, a small tablet.

Similarly, connectors 440 may correspond to a larger USB format and fits in receptacle 445. Because connectors 440 and receptacle 445 are larger, they may be utilized with a larger electronic device (e.g., 470). Electronic device 470 can be, for example, a tablet, an ULTRABOOK™, a laptop, a desktop, a projector a storage device. ULTRABOOK™ is a trademark of Intel Corporation in the U.S. and/or other countries.

Figure 5:
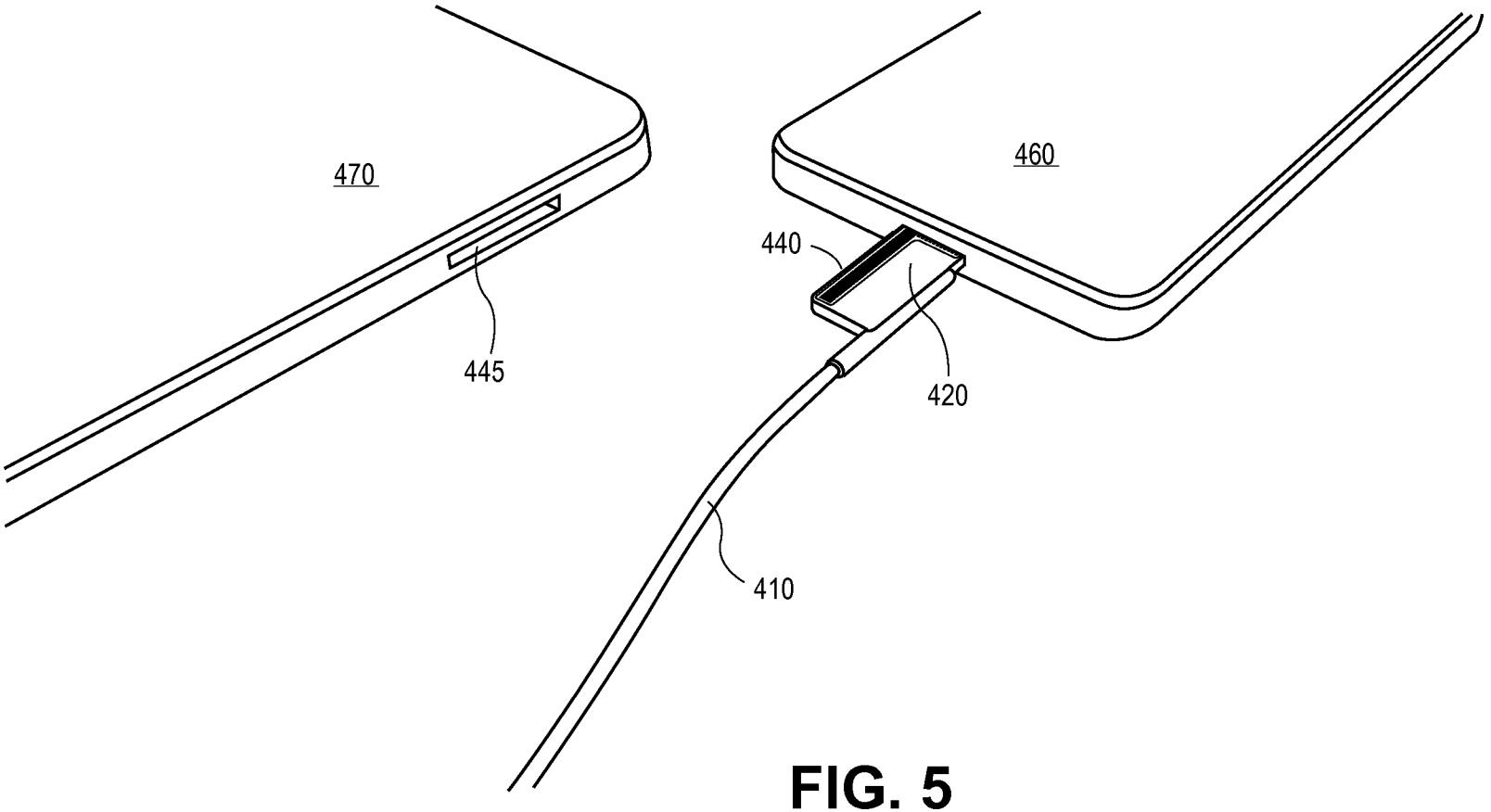
FIG. 5 illustrates a multiple-format USB cable connected to a smaller electronic device.

FIG. 5 illustrates a multiple-format USB cable connected to a smaller electronic device. In one embodiment, when connectors 430 (as indicated in FIG. 4) are connected with receptacle 435 (as indicated in FIG. 4) connectors 440 may be disabled. In one embodiment, one or more of connectors 430 may also be disabled depending on the format/protocol utilized to communicate with electronic device 460.

Figure 6:
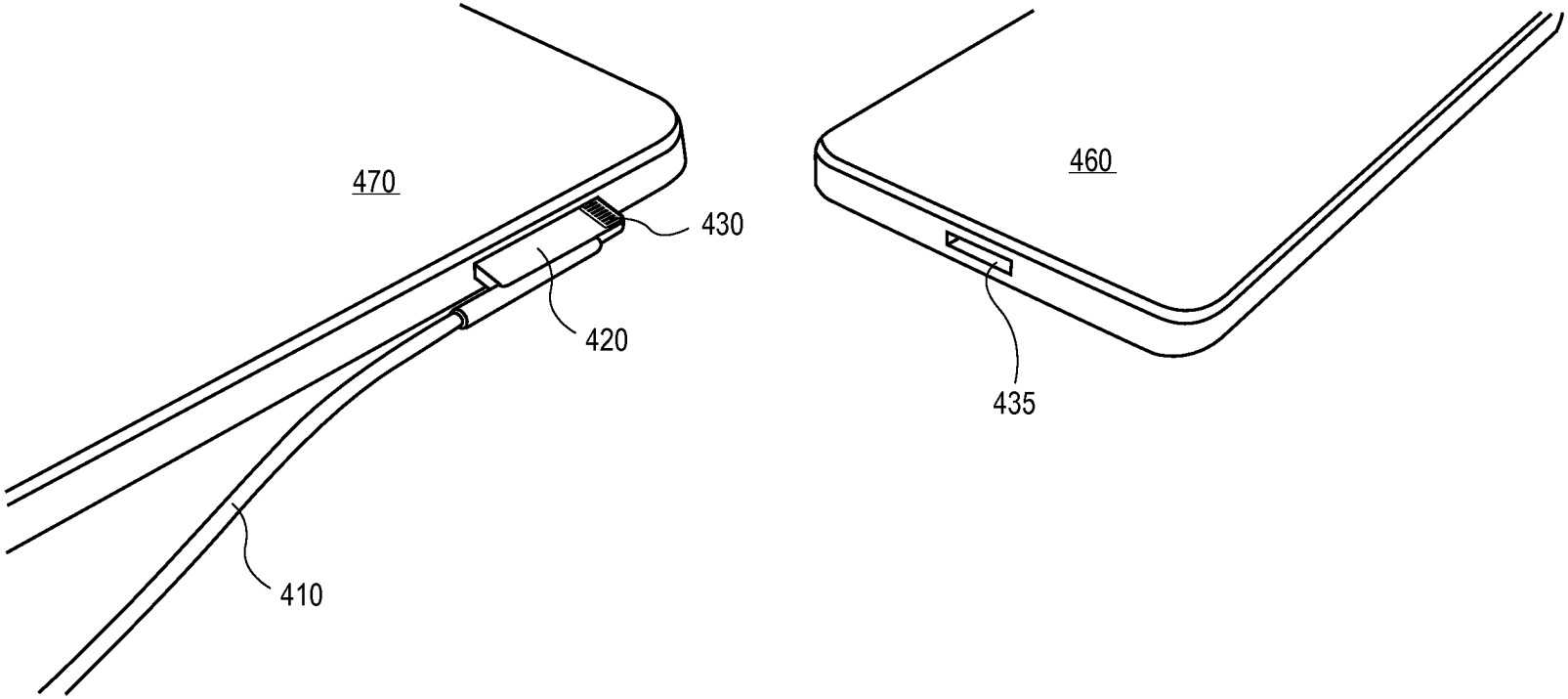
FIG. 6 illustrates a multiple-format USB cable connected to a larger electronic device.

FIG. 6 illustrates a multiple-format USB cable connected to a larger electronic device. In one embodiment, when connectors 440 (as indicated in FIG. 4) are connected with receptacle 445 (as indicated in FIG. 4) connectors 430 may be disabled. In one embodiment, one or more of connectors 440 may also be disabled depending on the format/protocol utilized to communicate with electronic device 470.

Figure 7:
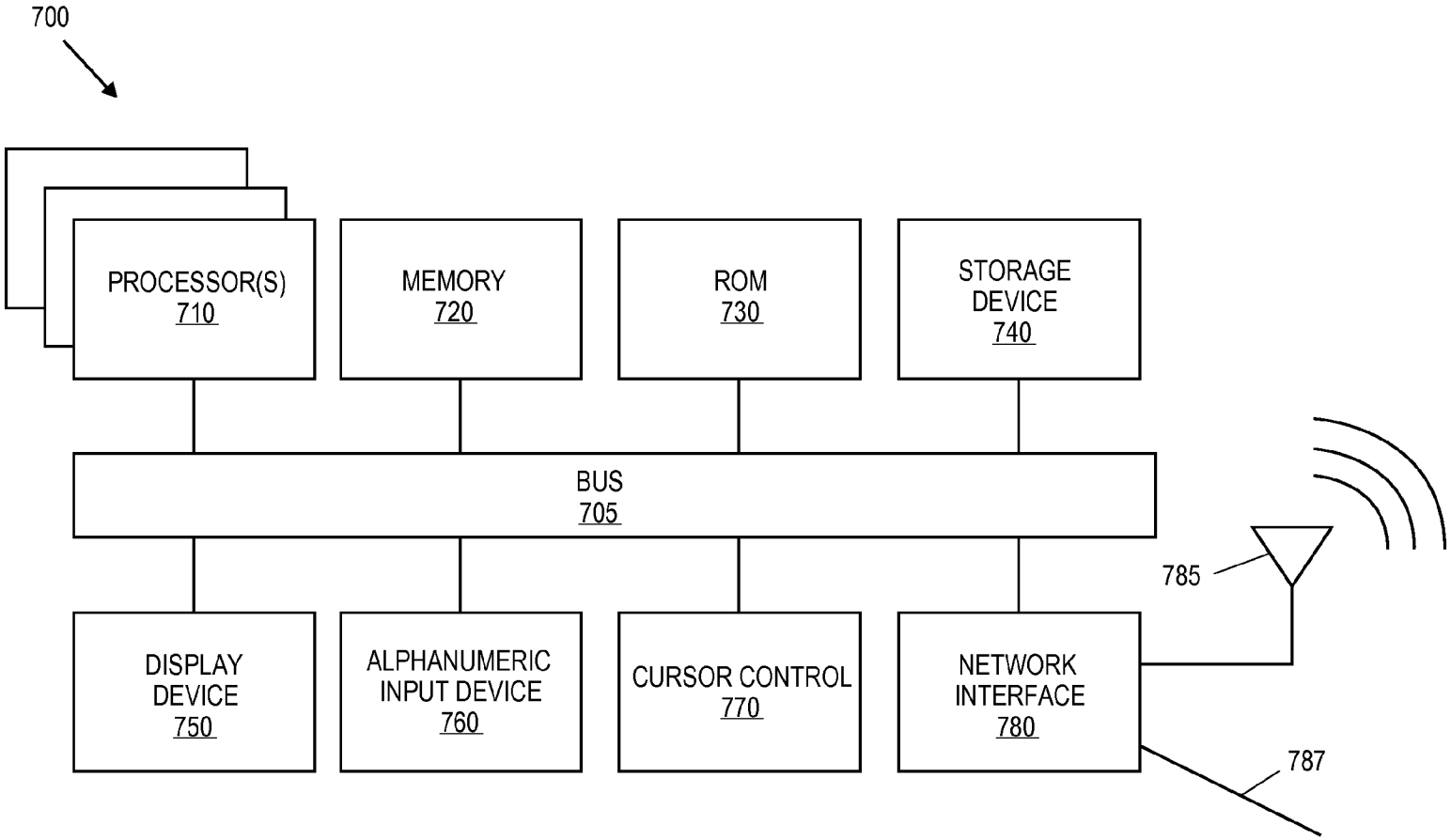
FIG. 7 is a block diagram of one embodiment of an electronic system.

FIG. 7 is a block diagram of one embodiment of an electronic system. The electronic system illustrated in FIG. 7 is intended to represent a range of electronic systems (either wired or wireless) including, for example, desktop computer systems, laptop computer systems, cellular telephones, personal digital assistants (PDAs) including cellular-enabled PDAs, set top boxes, tablets, etc. Alternative electronic systems may include more, fewer and/or different components.

Electronic system 700 includes bus 705 or other communication device to communicate information, and processor 710 coupled to bus 705 that may process information. While electronic system 700 is illustrated with a single processor, electronic system 700 may include multiple processors and/or co-processors. Electronic system 700 further may include random access memory (RAM) or other dynamic storage device 720 (referred to as main memory), coupled to bus 705 and may store information and instructions that may be executed by processor 710. Main memory 720 may also be used to store temporary variables or other intermediate information during execution of instructions by processor 710.

Electronic system 700 may also include read only memory (ROM) and/or other static storage device 730 coupled to bus 705 that may store static information and instructions for processor 710. Data storage device 740 may be coupled to bus 705 to store information and instructions. Data storage device 740 such as a magnetic disk or optical disc and corresponding drive may be coupled to electronic system 700.

Electronic system 700 may also be coupled via bus 705 to display device 750, such as a cathode ray tube (CRT) or liquid crystal display (LCD), to display information to a user. Alphanumeric input device 760, including alphanumeric and other keys, may be coupled to bus 705 to communicate information and command selections to processor 710. Another type of user input device is cursor control 770, such as a mouse, a trackball, or cursor direction keys to communicate direction information and command selections to processor 710 and to control cursor movement on display 750.

Electronic system 700 further may include network interface(s) 780 to provide access to a network, such as a local area network. Network interface(s) 780 may include, for example, a wireless network interface having antenna 785, which may represent one or more antenna(e). Network interface(s) 780 may also include, for example, a wired network interface to communicate with remote devices via network cable 787, which may be, for example, an Ethernet cable, a coaxial cable, a fiber optic cable, a serial cable, a parallel cable and/or USB (or other protocol/standard/format) interfaces as described herein.

In one embodiment, network interface(s) 780 may provide access to a local area network, for example, by conforming to IEEE 802.11b and/or IEEE 802.11g standards, and/or the wireless network interface may provide access to a personal area network, for example, by conforming to Bluetooth standards. Other wireless network interfaces and/or protocols can also be supported.

IEEE 802.11b corresponds to IEEE Std. 802.11b-1999 entitled "Local and Metropolitan Area Networks, Part 11: Wireless LAN Medium Access Control (MAC) and Physical Layer (PHY) Specifications: Higher-Speed Physical Layer Extension in the 2.4 GHz Band," approved Sep. 16, 1999 as well as related documents. IEEE 802.11g corresponds to IEEE Std. 802.11g-2003 entitled "Local and Metropolitan Area Networks, Part 11: Wireless LAN Medium Access Control (MAC) and Physical Layer (PHY) Specifications, Amendment 4: Further Higher Rate Extension in the 2.4 GHz Band," approved Jun. 27, 2003 as well as related documents. Bluetooth protocols are described in "Specification of the Bluetooth System: Core, Version 1.1," published Feb. 22, 2001 by the Bluetooth Special Interest Group, Inc. Associated as well as previous or subsequent versions of the Bluetooth standard may also be supported.

In addition to, or instead of, communication via wireless LAN standards, network interface(s) 780 may provide wireless communications using, for example, Time Division, Multiple Access (TDMA) protocols, Global System for Mobile Communications (GSM) protocols, Code Division, Multiple Access (CDMA) protocols, and/or any other type of wireless communications protocol.

In one embodiment, an apparatus includes a connector body having a top side and a bottom side, and having a first edge and a second edge and a plurality of electrical connectors along the first edge and the second edge, wherein the, wherein the connectors on the first edge conform to a first interface format and the connectors on the second edge conform to a second interface format.

In one embodiment, the first interface format comprises a first Universal Serial Bus (USB)-compliant format and the second interface format comprises a second USB-compliant format. In one embodiment, the plurality of electrical connectors comprises at least a first set of electrical connectors along the first edge on the top side of the connector body and a second set of electrical connectors along the first edge on the bottom side of the connector body.

In one embodiment, the plurality of electrical connectors comprises at least a third set of electrical connectors along the second edge on the top side of the connector body and a fourth set of electrical connectors along the second edge on the bottom side of the connector body. In one embodiment, one or more of the plurality of electrical connectors is to be selectively disabled based on an interface format.

In one embodiment, there are one or more detents on the connector body. In one embodiment, the first edge is longer than the second edge. In one embodiment, the connector body includes a grip portion connected to the connector body. In one embodiment, a cable having one or more transmission lines is coupled with one or more of the electrical connectors.

In one embodiment, an electrical connector cable includes a first connector body having a top side and a bottom side, and having a first edge and a second edge and a plurality of electrical conductors. The connector body has first plurality of electrical connectors along the first edge and the second edge, the first plurality of electrical connectors coupled with a first end of the plurality of electrical conductors. The connectors on the first edge conform to a first Universal Serial Bus (USB)-compliant interface format and the connectors on the second edge conform to a second USB-compliant interface format.

In one embodiment, the plurality of electrical connectors comprises at least a first set of electrical connectors along the first edge on the top side of the connector body and a second set of electrical connectors along the first edge on the bottom side of the connector body. In one embodiment, the plurality of electrical connectors comprises at least a third set of electrical connectors along the second edge on the top side of the connector body and a fourth set of electrical connectors along the second edge on the bottom side of the connector body.

In one embodiment, the cable further includes a second connector body having a top side and a bottom side, and having a first edge and a second edge and a second plurality of electrical connectors along the first edge and the second edge. The second plurality of electrical connectors are coupled with a second end of the plurality of electrical conductors. The connectors on the first edge conform to the first USB-compliant interface format and the connectors on the second edge conform to the second USB-compliant interface format.

In one embodiment, an apparatus includes a connector body having a first side and a second side, and having a first edge and a second edge and a plurality of electrical connectors along the first edge and the second edge. The connectors on the first edge conform to a first interface format and the connectors on the second edge conform to a second interface format. In one embodiment, the first interface format comprises a first Universal Serial Bus (USB)-compliant format and the second interface format comprises a second USB-compliant format.

In one embodiment, the plurality of electrical connectors comprises at least a first set of electrical connectors along the first edge on the first side of the connector body and a second set of electrical connectors along the first edge on the second side of the connector body. In one embodiment, the plurality of electrical connectors include at least a third set of electrical connectors along the second edge on the first side of the connector body and a fourth set of electrical connectors along the second edge on the second side of the connector body.

In one embodiment, one or more of the plurality of electrical connectors is to be selectively disabled based on an interface format. In one embodiment, the apparatus further includes one or more detents on the connector body. In one embodiment, the first edge is longer than the second edge. In one embodiment, the apparatus further includes a grip portion connected to the connector body. In one embodiment, the apparatus further includes a cable having one or more transmission lines coupled with one or more of the electrical connectors.

In one embodiment, an electrical cable includes a first connector body having a first side and a second side, and having a first edge and a second edge, a plurality of electrical conductors, and a first plurality of electrical connectors along the first edge and the second edge. The first plurality of electrical connectors are coupled with a first end of the plurality of electrical conductors. The connectors on the first edge conform to a first interface format and the connectors on the second edge conform to a second interface format.

In one embodiment, the first interface format is a first Universal Serial Bus (USB)-compliant format and the second interface format is a second USB-compliant format. In one embodiment, the plurality of electrical connectors comprises at least a first set of electrical connectors along the first edge on the top side of the connector body and a second set of electrical connectors along the first edge on the bottom side of the connector body. In one embodiment, the plurality of electrical connectors comprises at least a third set of electrical connectors along the second edge on the top side of the connector body and a fourth set of electrical connectors along the second edge on the bottom side of the connector body.

In one embodiment, the cable further includes a second connector body having a top side and a bottom side, and having a first edge and a second edge and a second plurality of electrical connectors along the first edge and the second edge, second plurality of electrical connectors coupled with a second end of the plurality of electrical conductors. The connectors on the first edge conform to the first USB-compliant interface format and the connectors on the second edge conform to the second USB-compliant interface format.

In one embodiment, one or more of the plurality of electrical connectors is to be selectively disabled based on an interface format. In one embodiment, the cable further includes one or more detents on the connector body. In one embodiment, the first edge is longer than the second edge. In one embodiment, the cable further includes a grip portion connected to the connector body. In one embodiment, the cable further includes one or more transmission lines coupled with one or more of the electrical connectors.

In one embodiment, an apparatus includes a connector body having a first side and a second side, and having a first edge and a second edge and a plurality of electrical connectors along the first edge of the first side and the first edge of the second side. The connectors on the first edge of the first side conform to a first interface format and the connectors on the first edge of the second side conform to a second interface format.

In one embodiment, the first interface format is a first Universal Serial Bus (USB)-compliant format and the second interface format is a second USB-compliant format. In one embodiment, the plurality of electrical connectors comprises at least a third set of electrical connectors along the second edge on the first side of the connector body and a fourth set of electrical connectors along the second edge on the second side of the connector body.

In one embodiment, one or more of the plurality of electrical connectors is to be selectively disabled based on an interface format. In one embodiment, the apparatus further includes one or more detents on the connector body. In one embodiment, the first edge is longer than the second edge. In one embodiment, the apparatus further includes a grip portion connected to the connector body. In one embodiment, the apparatus further includes a cable having one or more transmission lines coupled with one or more of the electrical connectors.

In one embodiment, one or more of the plurality of electrical connectors is to be selectively disabled based on an interface format. In one embodiment, the cable includes one or more detents on the connector body. In one embodiment, the first edge is longer than the second edge. In one embodiment, the cable includes a grip portion connected to the connector body. In one embodiment, the cable has one or more transmission lines coupled with one or more of the electrical connectors.

Reference in the specification to "one embodiment" or "an embodiment" means that a particular feature, structure, or characteristic described in connection with the embodiment. The appearances of the phrase "in one embodiment" in various places in the specification are not necessarily all referring to the same embodiment. The description is thus to be regarded as illustrative instead of limiting.

What is claimed is:

1. An apparatus comprising:

a cable connected to a connector body having a first side and a second side opposite the first side, the first side of the connector body having a first edge and a second edge adjacent to the first edge, the first edge being different than the second edge: and a plurality of electrical connectors, each of the plurality of electrical connectors having contact pads on the connector body, the plurality of electrical connectors including at least a first set of electrical connectors on the first side located along the first edge and a second set of connectors on the first side located along the second edge, wherein the first set of connectors located along the first edge conform to a first interface format and the second set of connectors located along the second edge conform to a second interface format, wherein the first and second sets of electrical connectors are selectively disabled such that only one of the first and second sets of electrical connectors operate at any one time;

wherein the first interface format comprises a first Universal Serial Bus (USB)-compliant format and the second interface format comprises a second USB-compliant format; and the apparatus further comprising a grip portion cover a portion of the connector body and the cable.

2. The apparatus of claim 1, wherein either the first set of electrical connectors or the second set of electrical connectors is to be selectively disabled based on an interface format.

3. The apparatus of claim 1, further comprising at least a first detent on the connector body to hold the connector body in a receptacle with the connector body being in a first orientation and a second detent on the connector body to hold the connector body in a receptacle with the connector body being in a second orientation.

4. The apparatus of claim 1, wherein the first edge of the first side and the second side is longer than the second edge of the first side and second side.

5. The apparatus of claim 1 further comprising the cable having one or more transmission lines coupled with one or more of the electrical connectors.

6. An electrical connector cable comprising:

a first connector body having a first side and a second side opposite the first side, the first side and second side of the connector body each having a first edge and a second edge adjacent to the first edge, the first edge being different than the second edge:

a plurality of electrical conductors within a cable; and a plurality of electrical connectors, each of the plurality of electrical connectors having contact pads on the connector body, the plurality of electrical connectors including at least a first set of electrical connectors located along the first edge of the first side and a second set of electrical connectors located along the second edge of the first side, wherein the plurality of electrical connectors is coupled with a first end of the plurality of electrical conductors, and wherein the first set of connectors located along the first edge of the first side conform to a first interface format and the second set of connectors located along the second edge of the first side conform to a second interface format, wherein the first and second sets of electrical connectors are selectively disabled such that only one of the first and second sets of electrical connectors operate at any one time;

wherein the first interface format comprises a first Universal Serial Bus (USB)-compliant format and the second interface format comprises a second USB-compliant format;

the apparatus further comprising a grip portion cover a portion of the connector body and the cable.

7. The cable of claim 6, further comprising:

a second connector body having a first side and an opposite side, and having a first edge and a second edge; and a second plurality of electrical connectors, each of the plurality of electrical connectors having contact pads on the second connector body, the second plurality of electrical connectors including at least a first set of electrical connectors on the first side located along the first edge of the first side and a second set of electrical connectors on the first side located along the second edge of the first side, wherein the second plurality of electrical connectors is coupled with a second end of the plurality of electrical conductors, and wherein the first set of connectors located along the first edge of the first side conform to the first USB-compliant interface format and the second set of connectors located along the second edge of the first side conform to the second USB-compliant interface format.

8. The cable of claim 6, wherein either the first set of electrical connectors of the second set of electrical connectors is to be selectively disabled based on an interface format.

9. The cable of claim 6, further comprising at least a first detent on the connector body to hold the connector body in a receptacle with the connector body being in a first orientation and a second detent on the connector body to hold the connector body in a receptacle with the connector body being in a second orientation.

10. The cable of claim 6, wherein the first edge of the first side and second side is longer than the second edge of the first side and second side.

* * * * *